US005994682A

United States Patent [19]

Kelly et al.

[11] Patent Number: 5,994,682

[45] Date of Patent: Nov. 30, 1999

[54] INDUCTION HEATING DEVICE WITH A QUICK DISCONNECT TERMINAL AND METHOD OF USE

[75] Inventors: Michael W. Kelly, Joliet, Ill.; Glenn F. Jorgensen, Ridgewood, N.J.; Joe Stambaugh, Columbus, Ohio

[73] Assignees: Power House Tool, Inc., Joliet, Ill.; JNT Technical Services, Inc., Little Ferry, N.J.; Alpha 1 Induction Service Center, Columbus, Ohio

[21] Appl. No.: 09/097,362

[22] Filed: Jun. 15, 1998

Related U.S. Application Data

[63] Continuation-in-part of application No. 08/986,884, Dec. 8, 1997.

[51] Int. Cl.[6] ..... H05B 6/08

[52] U.S. Cl. ..... 219/644; 174/15.7

[58] Field of Search ..... 219/637, 646, 219/603, 607, 608, 644, 632, 677; 174/15.7

[56] References Cited

U.S. PATENT DOCUMENTS

| | | | |
|---|---|---|---|
| 2,176,601 | 10/1939 | Bates . | |
| 2,810,053 | 10/1957 | Messner . | |
| 3,632,948 | 1/1972 | Moulin | 219/646 |
| 3,686,459 | 8/1972 | Lewis | 219/644 |
| 3,771,209 | 11/1973 | Bennett . | |
| 4,075,450 | 2/1978 | Lavins, Jr. | 219/632 |
| 4,625,090 | 11/1986 | Pfaffmann et al. | 219/644 |
| 5,397,876 | 3/1995 | Shimamoto et al. . | |
| 5,414,246 | 5/1995 | Shapona | 219/640 |
| 5,418,069 | 5/1995 | Learman . | |
| 5,529,747 | 6/1996 | Learman . | |

*Primary Examiner*—Teresa Walberg
*Assistant Examiner*—Jeffrey Pwu
*Attorney, Agent, or Firm*—Hill & Simpson

[57] ABSTRACT

An induction heating device having a pair of inductors in a sub-assembly connected by fluid conduits to a cooling apparatus and by electrical conductors to an inverter and impedance adjusting circuit has a quick disconnect terminal assembly arranged closely adjacent to the inductors. This permits the inductor sub-assembly to be quickly and easily disconnected from the conduits and conductors so that the inductor sub-assembly may be moved to a new location easily and quickly. A plurality of inductor subassemblies may be used with a single terminal assembly to provide an accelerated method of heating a series of items by successively moving the terminal assembly to a next inductor sub-assembly to begin heating and to then move the non-disconnected inductor assembly to a new location while the next inductor sub-assembly is operating.

20 Claims, 3 Drawing Sheets

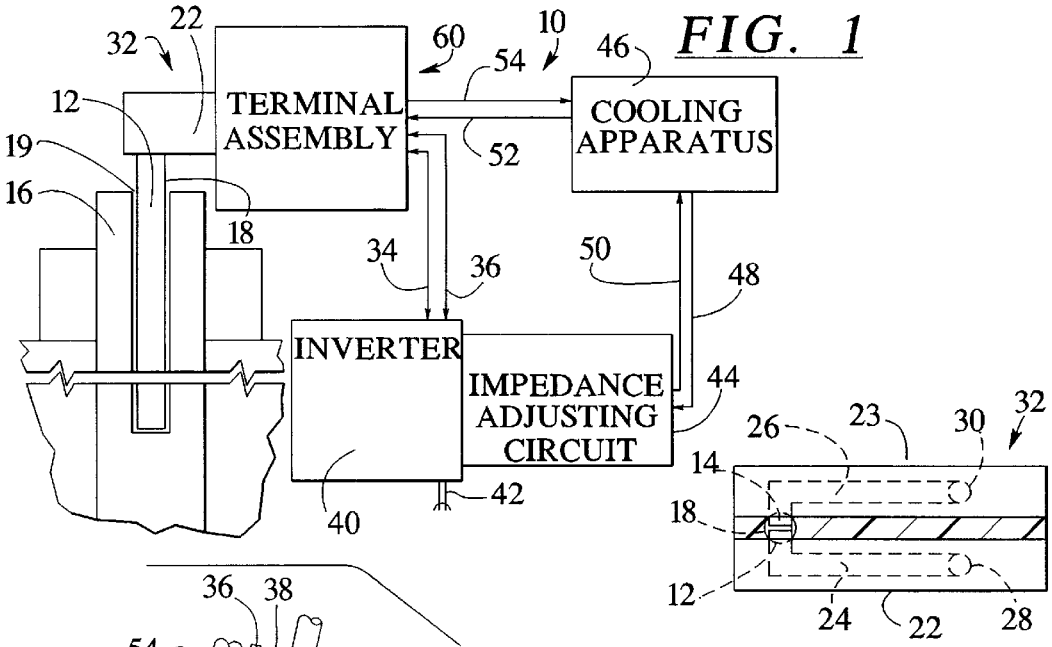
FIG. 1
FIG. 2
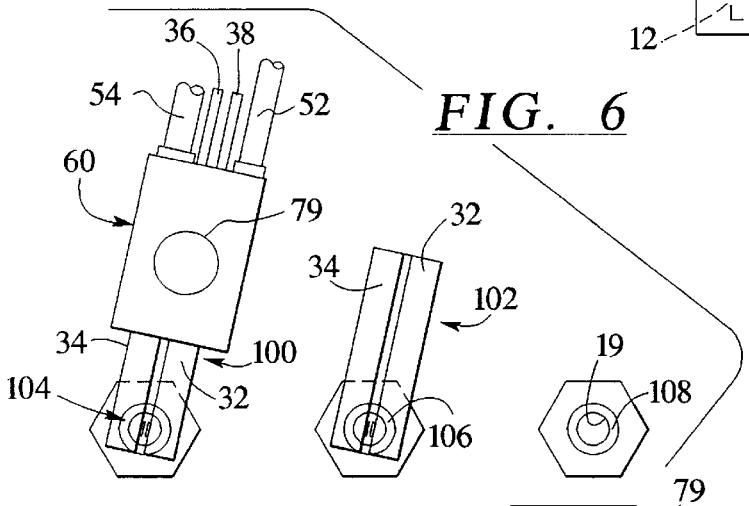
FIG. 6
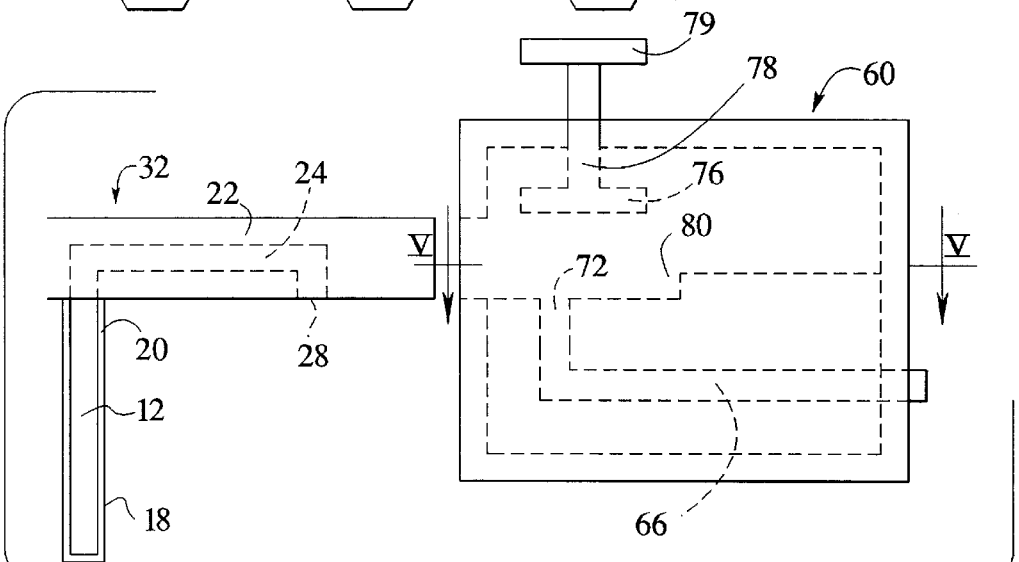
FIG. 3

INDUCTION HEATING DEVICE WITH A QUICK DISCONNECT TERMINAL AND METHOD OF USE

BACKGROUND OF THE INVENTION

This application is a continuation-in-part of application Ser. No. 08/986,884, filed Dec. 8, 1997.

The present invention relates to induction heating devices and in particular to an induction heating device for heating a rod or post, such as a stud or threaded bolt.

The present invention has a particular application in the heating of studs or bolts, such as the bolts of a steam turbine casing. Although the invention is not limited to such an application, the invention will be described in such an environment and use.

It is desirable to heat the bolts used in a steam turbine casing during the fasting and unfastening thereof in that the bolt will elongate due to expansion during heating allowing the nut to be threaded onto the bolt to a greater degree during the fastening process. When the bolt cools and shrinks, the nut is pulled tighter against the surrounding surface, thus assuring a secure fasting of the nut on the bolt and a clamping of the parts held together by the nut and bolt. In order to ease the removal of the nut from the bolt, such as during the servicing of the turbine, it is helpful to again heat the bolt to elongate it, in order to move the nut away from the surrounding surface, or at least to lessen the force holding the nut against that surface.

It has long been known to heat bolts, for example see U.S. Pat. No. 2,176,601, and to use induction heating to heat such bolts, for example, see U.S. Pat. Nos. 3,771,209 and 5,397,876. It has also been long known to use induction heating inductors for heating objects with small diameter holes therein, for example, see U.S. Pat. No. 2,810,053. As described in U.S. Pat. No. 2,810,053, it is conventional to use hollow inductors so that a cooling fluid may be directed through the inductors to keep them relatively cool during the heating process while the object into which the inductors are inserted is heated.

It is also known to use some type of material in association with the inductors to direct or concentrate the magnetic flux generated by the inductors in order to enhance the heating process. For example, see U.S. Pat. Nos. 5,418,069 and 5,529,747 which describe a particular type of material which may be used.

Thus, typically, there is a source of electrical current, for example, supplied by an inverter which provides an alternating current at a variable frequency. An impedance adjusting circuit, having various switchable capacitors, is used to adjust an impedance load to the inverter. As is known, cooling apparatus is used in association with the inverter and impedance adjusting circuit in that high heat is generated due to the high current used and the significant power losses associated with these devices. The cooling apparatus is also used to supply a cooling fluid to the hollow inductors which are inserted into the axial hole formed in the bolt.

Thus, the inductors must be supplied with both electric current and cooling fluid during their operation.

In the past, the connections of the cooling fluid and the electrical current to the inductors have resulted in unwieldily and rigid assemblies of electrical cables and fluid conduits which are relatively permanently attached to the inductors. This arrangement requires significant labor exertions to move the inductors from bolt to bolt during the heating process, and results in the expenditure of significant time and effort to conduct the bolt heating process, particularly in installations where tens of bolts must be heated and fastened or unfastened in connection with a particular device, such as a steam turbine casing.

It would be an advance in the art if there were provided an easy to use induction heating device and a method for heating multiple items, such as bolts.

SUMMARY OF THE INVENTION

An induction heating device in accordance with the principles of the present invention comprises a quick disconnect terminal assembly for the fluid conduits and for the electrical conductors, closely adjacent to the inductors, so that the inductors may be released from their connections and moved from bolt to bolt without all of the conduits and conductors attached thereto. This also permits the conduits and conductors to be removed from one set of inductors and connected to another set of inductors quickly and easily, so that the second set of inductors can begin heating another bolt while continuing operation can occur on the bolt from which the conduits and conductors have just been removed. By using this method, the entire heating process on a series of items, such as bolts, can proceed much more quickly than with present methods.

BRIEF DESCRIPTION OF THE DRAWINGS

FIG. 1 is a side sectional and schematic view of an induction heating device embodying the principles of the present invention.

FIG. 2 is a top elevational view of the inductor sub-assembly.

FIG. 3 is a side sectional view of the inductor sub-assembly and a quick disconnect terminal for fluid conduits and current conductors for the induction heating device shown in FIG. 1, in a disconnected condition.

FIG. 6 is a top view of a series of bolts being sequentially heated with a plurality of inductor subassemblies and a single terminal assembly.

DETAILED DESCRIPTION OF THE PREFERRED EMBODIMENTS

Figure 4:
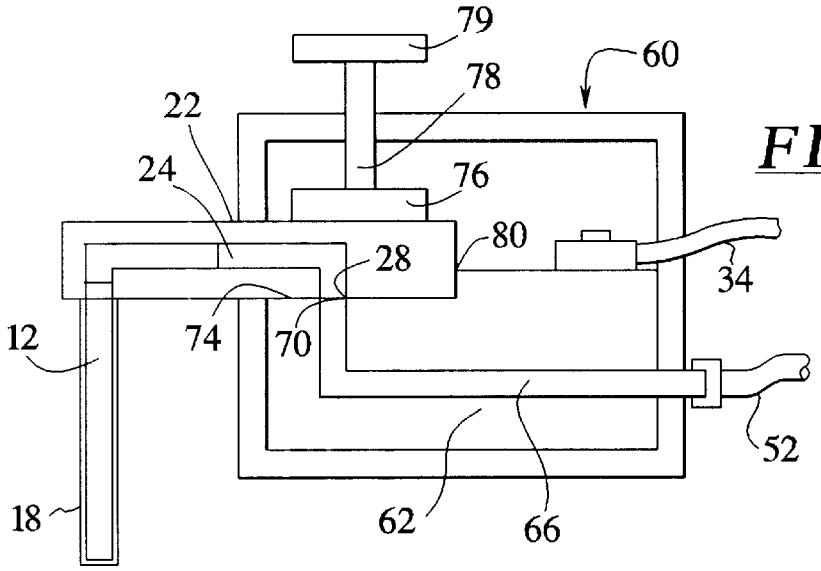
FIG. 4 is a side sectional view of an inductor sub-assembly and a quick disconnect terminal assembly for fluid and current conductors for the induction heating device shown in FIG. 1, in a connected condition.

In FIG. 1 an induction heating device is shown generally at 10 which is useful in relatively quickly heating an object by insertion of a pair of inductors 12, 14 (FIG. 2) into a ferrous object and providing an alternating current of a certain frequency to the inductors. Although the present invention can be used to rapidly heat a variety of objects, the invention is particularly suited to heat rods or posts, such as threaded bolts or studs 16 of the type used in steam turbine casings. The inductors 12, 14 are positioned within a sleeve 18 and may be separated from each other by various materials 20, such as the flux concentrator described in U.S. Pat. Nos. 5,418,069 and 5,529,747, which disclosures are incorporated herein by reference. The sleeve 18 has an outer diameterjust slightly smaller than a bore or opening 19 into which the sleeve 18 is to be inserted to perform the heating. For example, in the environment of a steam turbine casing bolt 16, the bolt, which may have a diameter of 4 to 6 inches would be provided with a bore 19 having a diameter of about one inch and the sleeve would have an outer diameter of just slightly less than one inch.

The inductors 12,14 are formed as hollow tubes, preferably from copper, which may have one of a variety of cross-sectional shapes, such as round, square, half round, or other shapes. The distal ends of the inductors, in the sleeve 18, are connected for fluid flow and electrical current flow, thus forming a hollow, single loop conductor. As best seen in FIGS. 2 and 3, the ends of the inductors 12, 14 which extend out of the sleeve 18 are fluid sealingly and electrically conductively captured by a pair of electrically isolated blocks 22, 23 either by insertion and sealing thereinto, or they may be secured by threaded or other connection to the blocks, so long as the hollow inductors have their interior passages fluidly sealed to respective interior passages 24, 26 within the blocks 22, 23. The passages 24, 26 in the blocks terminate in openings 28, 30 in common facing walls 32, 33 of the blocks. The inductors 12, 14, sleeve 18 and block 22 thus form an inductor sub-assembly 32.

As schematically shown in FIG. 1, electrical current is provided to the inductors 12, 14 by cables or conductors 34, 36 from an inverter 40 which receives power from a power main 42. An impedance adjusting circuit 44 is connected to the inverter 40 to provide an appropriate and adjustable resonant frequency (typically in the range of 3 to 30 kHz) to the inductors 12, 14.

Due to the large currents involved (up to 2000 Amps), the inverter 40 and impedance adjusting circuit 44 experience high energy losses resulting in heat which must be removed by cooling. A cooling apparatus 46 which can provide a recirculating source of a cooled fluid, such as chilled water, is connected by conduits 48, 50 to the inverter 40 and the circuit 44. In some applications the cooling apparatus 46 may merely be a connection to a source of tap water, the return water being disposed to a drain. In other applications a refrigeration device and pump will be used to chill and re-circulate the water or other refrigerant. The cooling apparatus 46 is also connected to the hollow inductors 12, 14 through conduits 52, 54 so that the inductors themselves will remain cool, even though the material surrounding them while they are operating, such as the bolt, is heated.

Figure 5:
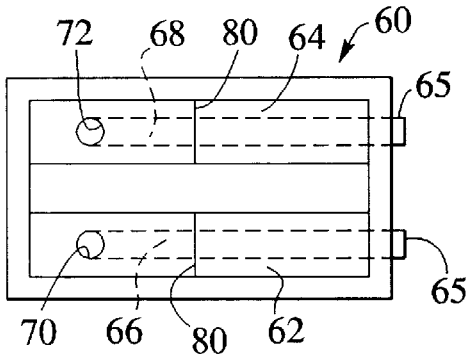
FIG. 5 is a sectional view of the terminal assembly taken generally along the lines V—V of FIG. 3.

In order to assist in the movement and placement of the inductor sub-assembly 32 relative to the material to be heated, the fluid conduits 52, 54 and electrical cables 34, 36 extending from the cooling apparatus 46 and inverter 40 terminate in a quick disconnect terminal assembly 60. As best seen in FIGS. 3–5, the terminal assembly 60 may be provided with a pair of electrically conductive blocks 62, 64 (electrically isolated from each other) to which the coolant conduits 52, 54 and the electrical conductors 34, 36 may be attached. The method of attachment to these blocks can vary, so long as the coolant conduits are attached in a liquid tight manner and the electrical conductors are attached in an electrically transmissive manner. For example, the coolant conduits may be attached by threaded connections 65 to the block, or may be supplied with compression fittings or metallic, solderable fittings as is well known. The electrical conductors may be attached with terminal ends being screwed to the conductive blocks, or by means of crimping or with the use of snap in coimectors as is well known.

In one embodiment of the invention, the terminal blocks 62, 64 are provided with internal passages 66, 68 which terminate in openings 70, 72 in a face 74 of the blocks, which openings are designed to align with the openings 28, 30 in the blocks 22, 23 of the inductor sub-assembly when those blocks are inserted into the terminal assembly 60 to overlie the terminal assembly blocks. A clamp member 76, which may be moved by a threaded screw 78 having a gripable handle 79 or other securable moving arrangement, such as a lever and clamp, or an over center spring arrangement, is used to press the inductor sub-assembly blocks 32, 33 against the terminal assembly blocks 62, 64 to form a fluid tight seal between the respective fluid openings. A gasket or other sealing material may be provided to assure a fluid tight seal between the blocks.

Figure 7:
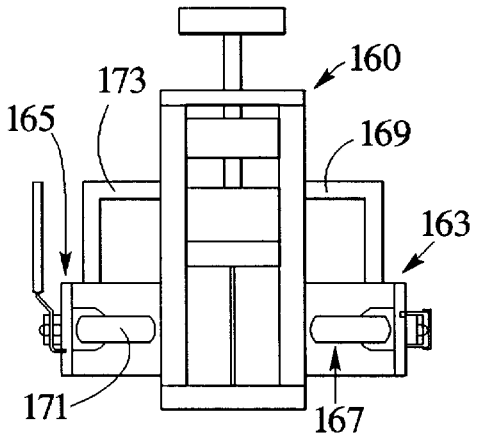
FIG. 7 is a front elevational view of a second embodiment of a quick disconnect terminal assembly for use with the present invention.
Figure 8:
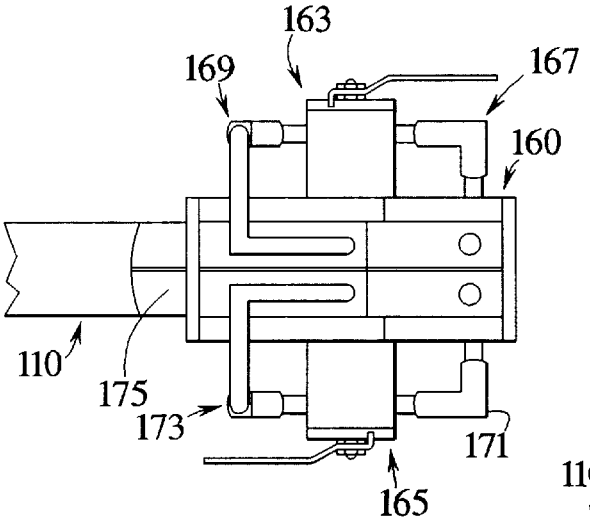
FIG. 8 is a top elevational view of the quick disconnect terminal assembly of FIG. 7.
Figure 9:
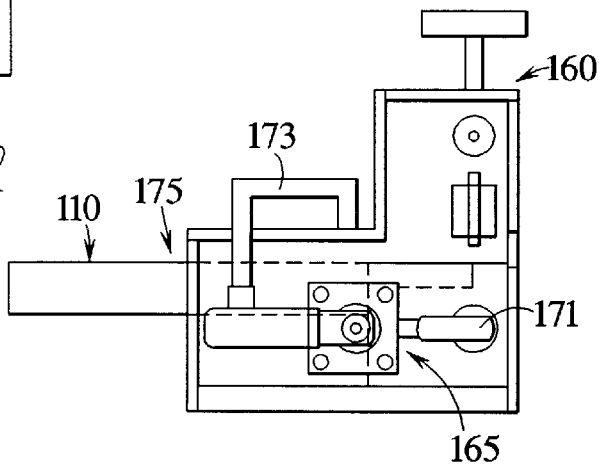
FIG. 9 is a side elevational view of the quick disconnect terminal assembly of FIG. 7.

In a second embodiment of the invention, as best seen in FIGS. 7–9, there is provided a quick disconnect terminal assembly 60 in which there are provided coolant shut offs in the form of manually operated valves 163, 165, mounted on the exterior of the terminal assembly 160. Non conductive bypass conduits 167, 169, 171 and 173 which, for example, can be formed of a plastic material, are provided to direct the flow of coolant through the valves 163, 165. These shut off valves permit a positive shut off of the coolant fluid, as well as a visible indication of the fluid shut off, and electrically isolate the valve members from the current flow through the terminal assembly 160. Thus, when the inductor sub-assembly 32 is to be disconnected, the shut off valves can be manually moved into a closed position to terminate fluid flow into the inductor sub-assembly in order to minimize any fluid leakage. Alternatively, the valves 163, 165 can be provided as automatic check valves. It is desirable, however, to electrically isolate the valves by utilizing the bypass conduits 167, 169, 171, 173, regardless of valve type.

This embodiment also illustrates the electrical conductors and current conductors as being combined into a single combined conductor with a single connection point at 175 as described in more detail below.

To inductively heat a material, such as a bolt, the inductor sub-assembly 22, separate from the terminal assembly 60, 160 and its connections to the cooling apparatus 46 and the inverter 40, is moved to the material and the sleeve 18 is inserted into the bore in the material. The terminal assembly 60, 160 is then moved to the inductor sub-assembly 32 and the blocks 32, 33 of the sub-assembly are inserted into the terminal assembly until physical stops 80 prevent further insertion. The clamping member 76 is then operated to effect the fluid tight seal, and electrical connection, between the two sets of blocks. The induction heating is then ready to begin by starting the coolant flow and the electrical current flow.

To inductively heat a second material, such as a second bolt in a series of bolts to be heated, although the entire inductor sub-assembly 32 and its connected terminal assembly 60 could be moved, the conduits 52, 54 and conductors 34, 36 are somewhat unwieldy and difficult to easily move, particularly when insertion of the inductors 12, 14 into a slender bore is required. Thus, it is much simpler to disconnect the terminal assembly 60 from the inductor sub-assembly 32 first, then move the inductor sub-assembly 32 to a new location and reattach the terminal assembly thereto. This allows for a much quicker movement of the inductor sub-assembly to a new location and prevents damage to the inductor sub-assembly due to misalignment during insertion into the bore.

An even quicker method of heating a series of bolts is shown in FIG. 6 involves the use of at least two separate inductor subassemblies 100, 102. A first inductor sub-assembly 100 is positioned in a first bolt 104 to be heated and the terminal assembly 60 is connected thereto to begin heating the first bolt. While the first bolt 104 is being heated, which will take several minutes, the second inductor sub-assembly 102 is positioned within the second bolt 106. Once the first bolt is heated, the terminal assembly 60 is disconnected from the first inductor sub-assembly 100 and is immediately connected to the second inductor sub-assembly 102 and the heating of the second bolt 106 is begun. The first inductor sub-assembly 100 can then be removed from the first bolt 104 to a third bolt 108 while the second bolt 106 is already heating. This alternating approach can be utilized to heat each of the bolts in the series to be heated.

As described above with respect to FIGS. 7–9, the electrical and fluid conductors may be combined into a single conductor assembly 110 (FIGS. 10–12) in which both fluid and electrical current flow through a single conductor, and with two, three, four or more such conductors combined together to form the assembly 110.

Figure 11:
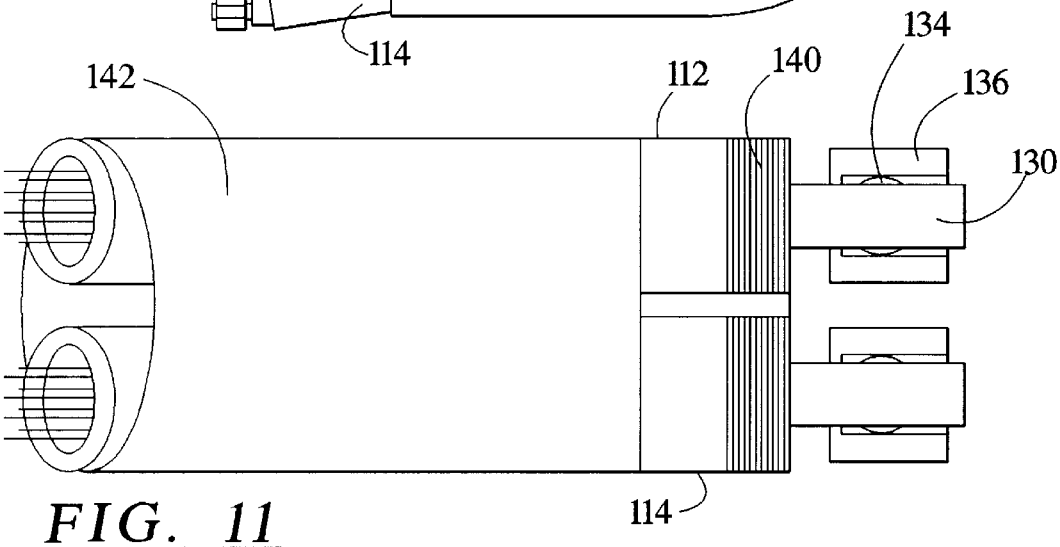
FIG. 11 is an enlarged, partial elevation and section view of a terminal end of the fluid conduit and current conductor of FIG. 10.
Figure 12:
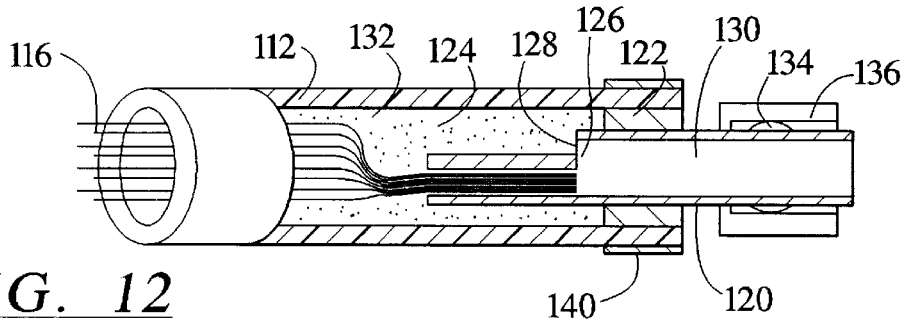
FIG. 12 is a partial sectional view of one of the fluid and current conductor of FIG. 11.

Specifically, there may be provided a first flexible tube 112 and a second flexible tube 114 which are shown in greater detail in FIGS. 11 and 12. Tube 112 for example (tube 114 being identical) comprises an outer flexible elastomeric tube within which is carried a length of Litz wire conductors 116. Litz wire is especially useful in a high power induction cable in that the Litz wire comprises individual copper strands that are separately insulated and are twisted or braided together to form the cable. This provides a flexible cable, yet the individual insulating equalizes the flux linkages and reactances thus substantially reducing losses in the cable.

Figure 10:
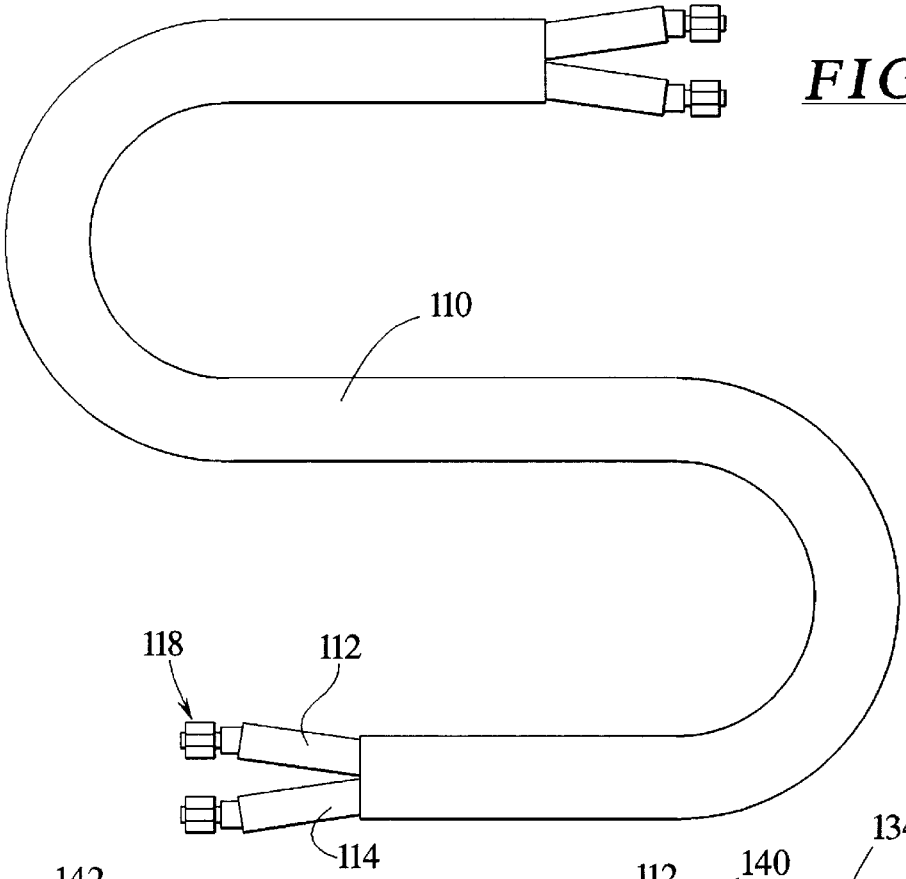
FIG. 10 is an elevational view of a fluid conduit and current conductor sub-assembly for use with the present invention.

At a terminal end 118 of each such conductor there is provided a copper tube 120 which extends into the tubing 112, but which has an outer diameter smaller than an inner diameter of the tubing 112. A copper sleeve bushing 122 is used to center the copper tube 120 within the flexible tube 112. The Litz wire 116 has its insulation removed at a terminal end and the ends of the individual strands are tinned. The copper tube 120 receives the terminal end of the Litz wire 116 therein and has an end portion which is laterally slit and then crimped at 124 and then soldered to the tinned end of the Litz wire to form an electrical connection between the Litz wire cable 116 and the copper tube 120. A lateral slit 126 is made in the copper tube 120 at the crimping point which provides for a passage area 128 from an anterior 130 of the copper tube 120 to an annular space 132 surrounding the Litz wire cable 116 within the flexible tubing 112. The interior of the copper tube 120 receives the cooling fluid, and the cooling fluid is allowed to pass from the copper tube 120 through the passage area 128 into the annular space 132 to flow in this space and within the individual Litz wire strands 116 along the length of the cable and to return to a similar copper tube located at the opposite end of the tube 112 as seen in FIG. 10.

A brass ferrule 134 and a brass compression nut 136 are used to secure the copper tube 120 to either the terminal assembly 60, 160 or to the cooling apparatus 46 and inverter 40, depending upon which end of the cable assembly 110 is being connected.

The terminal end of the tubing 112 is secured onto the copper tube 120 by one of a variety of clamping arrangements shown schematically at 140 which can include a stainless steel band, a tightly wound fiber wrap, or other similar known tube clamp devices.

The two individual conduits 112, 114 can be secured together by means of an outer wrap, such as a tubing material 142 such as a heat shrink tube covering. By holding the two conductors together with the heat shrinkable tubing, there is provided additional abrasion resistance and further reduction in inductance and associated losses by holding the conductors together in close proximity.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. An induction heating device comprising:

a pair of hollow inductors connected to form a hollow loop conductor for insertion into a ferrous material to be heated, a source of alternating current connected by conductors to said inductors, a source of cooling fluid connected by conduits to said inductors, a quick disconnect terminal comprising connection points for said inductors, said conductors and said conduits, said inductors being connected to said terminal in a fashion which permits said inductors to be released from said conductors and from said conduits.

2. An induction heating device according to claim 1, wherein said pair of hollow inductors each have a first end which is electrically isolated from the first end of the other conductor, and a second end which is electrically connected to the other conductor so as to form a horlow, single loop conductor for receiving said current and cooling fluid to flow therethrough.

3. An induction heating device according to claim 1, wherein said quick disconnect terminal comprises a clamping arrangement for receiving and securing said pair of hollow inductors and includes terminal assemblies for connecting to said conductors and conduits such that alternating current and cooling fluid pass from said conductors and conduits, through said quick disconnect terminal into said inductors.

4. An induction heating device according to claim 3, wherein said quick disconnect terminal includes fluid bypass conduits with fluid flow valves within said bypass conduits to permit termination of fluid flow at said quick disconnect terminal.

5. An induction heating device according to claim 1, wherein two electrical current conductors extend from said source of alternating current to said quick disconnect terminal and two fluid conduits extend from said source of cooling fluid to said quick disconnect terminal, with said conductors and conduits combined into a single assembly.

6. An induction heating device according to claim 5, wherein said single assembly comprises a first flexible and electrically non-conductive tubing and a second flexible electrically non-conductive tubing positioned side-by-side and held in close association by a surrounding wrap member, each of said tubings containing therein flexible electrical wire conductors which occupy less than the entirety of a cross sectional area of said flexible tubing so as to permit a flow of said cooling fluid through said tubing and around said wires, and terminal ends of each tubing configured so as to provide a coaxial flow of electrical current and cooling fluid therethrough, and connection means for attaching each of said tubings to said quick disconnect terminal and to said sources of alternating current and cooling fluid.

7. An induction heating device according to claim 6, wherein said connection means is a compression fitting carried on an electrically conductive metal tube, which tube is electrically connected to said electrical wires and is secured within an end of said tubing to transmit a flow of fluid through said metal tube into said non-conductive tube.

8. A method of heating a series of materials having bores therein by induction heating comprising the steps:

inserting a first pair of inductors into a first bore in a first material, connecting a source of alternating current and cooling fluid to said first pair of conductors, inserting a second pair of inductors into a second bore in a second material, disconnecting said source of alternating current and cooling fluid from said first pair of inductors once said first material is heated, and connecting said source of alternating current and cooling fluid to said second pair of inductors before removing said first pair of inductors from said first bore, and moving said first pair of inductors from said first bore to a third bore in a third material.

9. A method of heating a material having a bore therein by induction heating, comprising the steps:

inserting a pair of inductors into the bore in the material;

connecting a source of alternating electric current and a source of cooling fluid to said pair of inductors through a quick disconnect terminal;

supplying alternating electrical current and a flow of cooling fluid through said quick disconnect terminal to said inductors to heat the material;

terminating said alternating electrical current and flow of cooling fluid; and disconnecting said inductors from said quick disconnect terminal.

10. An induction heating device according to claim 1, wherein said quick disconnect terminal comprises a member having separate attachment points for said pair of inductors, said conductors and said conduits.

11. An induction heating device according to claim 1, wherein said quick disconnect terminal comprises a member having common attachment points for said conductors and said conduits.

12. An induction heating device according to claim 1, wherein said quick disconnect terminal comprises a member having connection terminals to attachingly receive said inductors, to attachingly receive said conductors and to attachingly receive said conduits.

13. An induction heating device according to claim 3, wherein said clamping arrangement comprises a plate member pressingly engageable with said inductors by means of a threaded handle.

14. An induction heating device according to claim 1, wherein said connection points for said conduits comprise a compression fitting on a tube.

15. An induction heating device according to claim 1, wherein said inductors are releasably connected to said connection points by means of a threaded member.

16. An induction heating device according to claim 15, wherein said threaded member comprises a threaded clamping member holding said inductors in said quick disconnect terminal.

17. A method of heating a series of materials according to claim 8, wherein said step of disconnecting said source of alternating current and cooling fluid from said first pair of inductors comprises rotating a threaded member.

18. A method of heating a series of materials according to claim 8, wherein during said step of moving said first pair of inductors from said first bore to a third bore, said second pair of inductors remains in said second bore.

19. A method of heating a material according to claim 9, wherein said step of disconnecting said inductors from said quick disconnect terminal comprises rotating a threaded member.

20. A method of heating a material according to claim 18, wherein said threaded member comprises a threaded clamping member holding said inductors in said quick disconnect terminal.

* * * * *